US005993752A

United States Patent [19]

Kobayashi

[11] Patent Number: 5,993,752

[45] Date of Patent: Nov. 30, 1999

[54] DEVICE FOR DISSOLVING A COAGULANT

[75] Inventor: Shogo Kobayashi, Shizuoka, Japan

[73] Assignee: Kobayashi Engineering Works, Ltd. Diafloc Company Limited, Shizuoka, Japan

[21] Appl. No.: 08/980,646

[22] Filed: Dec. 1, 1997

[30] Foreign Application Priority Data

Dec. 2, 1996 [JP] Japan ..... 8-334428
Oct. 28, 1997 [JP] Japan ..... 9-311025

[51] Int. Cl.[6] ..... B01F 7/02

[52] U.S. Cl. ..... 422/269; 366/300; 366/299; 366/307; 366/153.1; 366/168.1; 366/186

[58] Field of Search ..... 422/269, 255, 422/261, 273, 308, 309, 284; 425/207, 205; 366/300, 299, 307, 153.1, 168.1, 186, 158.5

[56] References Cited

U.S. PATENT DOCUMENTS

| | | | |
|---|---|---|---|
| 1,940,459 | 12/1933 | MacDonald | 23/267 |
| 2,703,274 | 3/1955 | Giesse et al. | 422/273 |
| 3,304,355 | 2/1967 | Pobst, Jr. et al. | 264/117 |
| 3,362,044 | 1/1968 | Irving | 18/12 |
| 4,246,224 | 1/1981 | Lehnen et al. | 264/328.14 |
| 4,249,877 | 2/1981 | Machen | 425/204 |
| 4,483,624 | 11/1984 | Bacon, Jr. et al. | 366/293 |
| 4,483,625 | 11/1984 | Fisher | 366/297 |
| 4,779,989 | 10/1988 | Barr | 366/90 |
| 4,801,433 | 1/1989 | Yamanaka et al. | 422/228 |
| 4,838,704 | 6/1989 | Carver | 366/307 |
| 4,938,605 | 7/1990 | Friedrich | 366/76 |
| 5,253,578 | 10/1993 | Hsu | 99/275 |
| 5,344,619 | 9/1994 | Larwick et al. | 422/261 |

FOREIGN PATENT DOCUMENTS

| | | |
|---|---|---|
| 52-45753 | 11/1977 | Japan . |
| 1384467 | 2/1975 | United Kingdom . |

*Primary Examiner*—Robert J. Warden, Sr.
*Assistant Examiner*—Andrew Aldag
*Attorney, Agent, or Firm*—Dvorak & Orum

[57] ABSTRACT

A device 10 for dissolving a coagulant having a rotor chamber 13 supporting rotors 21 around the horizontal axis, wherein a mixture of the coagulant and water is fed to the rotor chamber 13, the liquid level of the mixture is kept at a medium level of the rotors 21, and the mixture can be stirred vertically by means of the rotation of the rotors 21.

3 Claims, 7 Drawing Sheets

DEVICE FOR DISSOLVING A COAGULANT

BACKGROUND OF THE INVENTION

1. Field of the Invention

The present invention relates to a dissolving device in which a high molecular coagulant is gelled by adding water.

2. Description of Related Art

A coagulant which is a water-soluble polymer having a high molecular weight (for example, "DIAFLOC" produced by Diafloc Company Limited) has conventionally been used for the dehydration of sludge and the treatment of various kinds of waste water. The coagulant neutralizes the surface charge of colloids and particulate which are suspended in water to flocculate the particles thereof, and form large flocs by the absorption and crosslinking action to facilitate the settling or floatation of the suspended substances.

It is required that the coagulant is dissolved in water prior to the use and a diluted aqueous solution is prepared. The coagulant, however, is not easily dissolved in water in a short period of time, though it is water-soluble, and several hours are required to prepare a diluted aqueous solution in a single dissolving process. Generally, therefore, in such a procedure, a coagulant is first gelled, then a diluted aqueous solution is prepared. The coagulant in a gel form readily dissolves in water in several seconds.

The conventional dissolving device in which the coagulant is gelled by adding water uses a method in which, as shown in FIG. 7 of the drawings, water and the coagulant are put into a vessel of 100 $m^3$, a rotation axis is inserted therein from the upper side, and a stirrer having a propeller shape, fixed to a lower end of said rotation axis is rotated at a low speed to gel the coagulant in a period of 30 minutes to 1 hour, and this process is repeated. (This is a low-speed stirring batch treatment.)

The conventional method, however, utilizes low-speed stirring with a propeller-shaped stirrer and requires 30 minutes to 1 hour to gel the coagulant, result in the low productivity.

If the mixture of the coagulant and water is stirred at a high speed, the coagulant is not dissolved and the mixture becomes an aggregate of half-gelled particles which makes the half-dissolved coagulant a nucleus, and a readily water-soluble property is not obtained. Furthermore, the coagulant generally develops viscosity in the mixture as the coagulant is dissolved, and this viscosity can be referred to as a barometer which shows the cohesion (the absorption and crosslinking action) after the dilution. In the mixture stirred at a high speed, the viscosity is poor, which makes the flocculating force weak after the dilution.

SUMMARY OF THE INVENTION

The object of the present invention is to gel the mixture of a coagulant and water in a short period of time without harming the viscosity.

A device for dissolving a coagulant in which the coagulant is gelled by adding water according to the present invention, has a rotor chamber for supporting rotors around a horizontal axis, and a mixture of the coagulant and water is fed to the rotor chamber. The liquid level of the mixture is kept at a medium level of the rotors, and the mixture can be stirred in the vertical direction by the rotation of the rotors.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENTS

First Embodiment

FIGS. 1 to 6A and 6B

Figure 1:
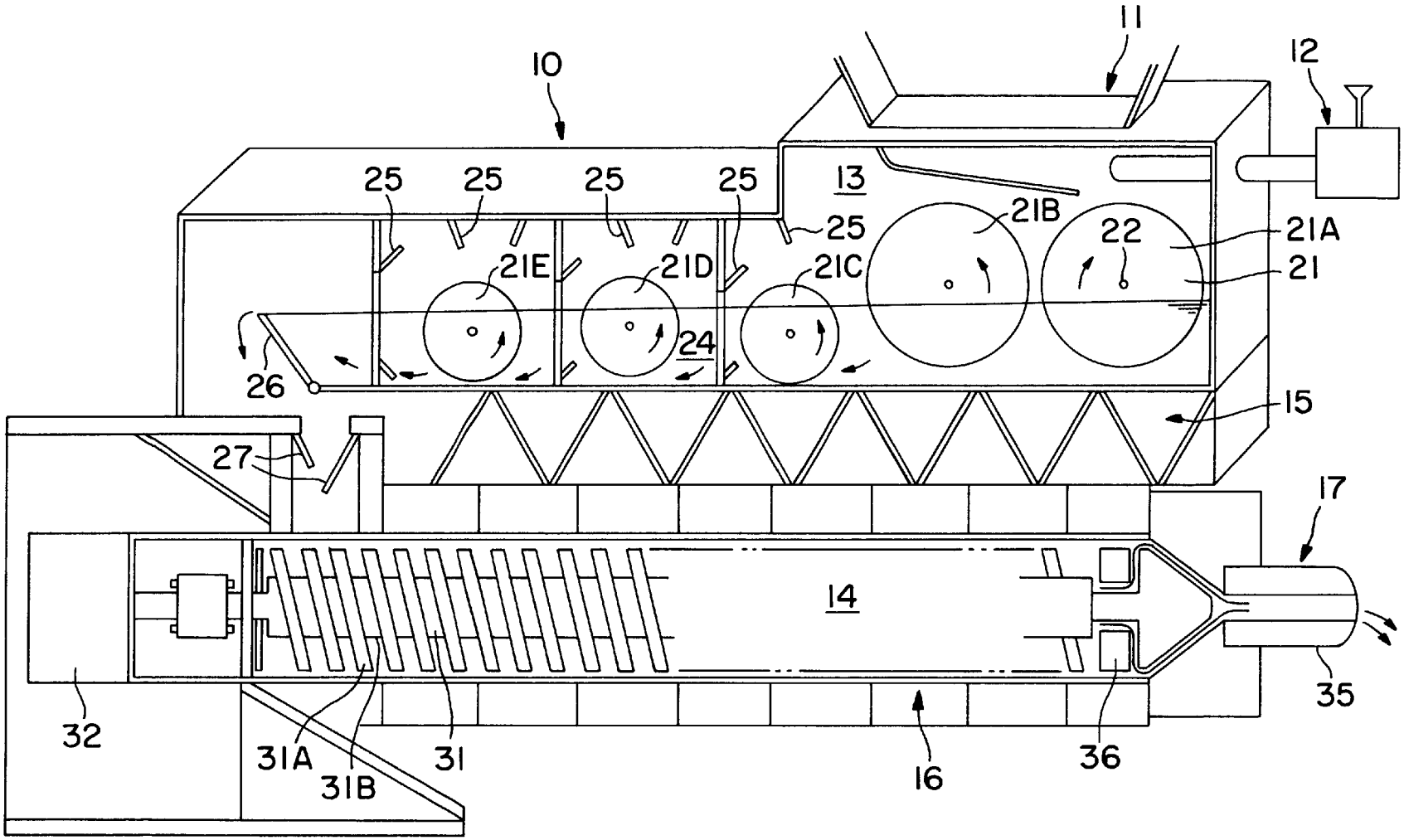
FIG. 1 is a schematic diagram showing the first embodiment of the dissolving device.

The dissolving device 10 is composed of a coagulant feed section 11, a water feed section 12, a rotor chamber 13, a screw chamber 14, a first heater 15, a second heater 16, and a mixture discharge section 17.

The coagulant feed section 11 feeds a coagulant (for example, a partially hydrolyzed polyacrylamide having a high molecular weight, such as "DIAFLOC" of Diafloc Company Limited, which is not uniform. Uniformity depends upon the partial hydrolysis rate in a molecular weight of about 500 million or more, but for example, the viscosity (measured by means of a Brookfield viscometer) of 0.1% aqueous solution in the case of the hydrolysis rate of 10% is about 100 CP or higher (Rotor No. 1, 6 rpm)) (see Japanese Patent Application Publication (JP-B) Nos. 52-45753, 52-47512, 53-3431, and 59-40842), and the water feed section 12 feeds water, and the coagulant and water are mixed and fed to the rotor chamber 13.

The rotor chamber 13 supports rotors 21 driven by a motor (not shown) around a horizontal rotor axis 22. The liquid level of the mixture is kept at a medium level of the rotors 21, and the mixture is stirred in the vertical direction by low-speed rotation of the rotors 21.

Figure 2A:
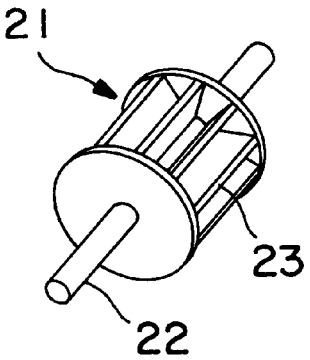
FIGS. 2A to 2C are schematic diagrams showing a rotor.
Figure 2B:
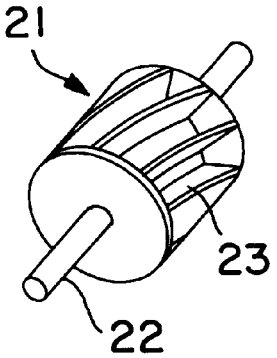
Figure 2C:
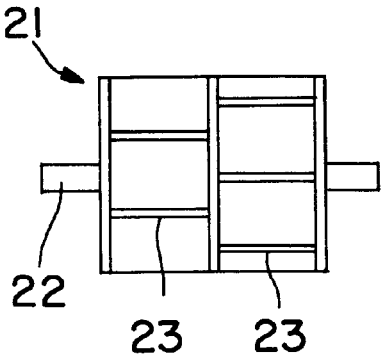
Figure 3:
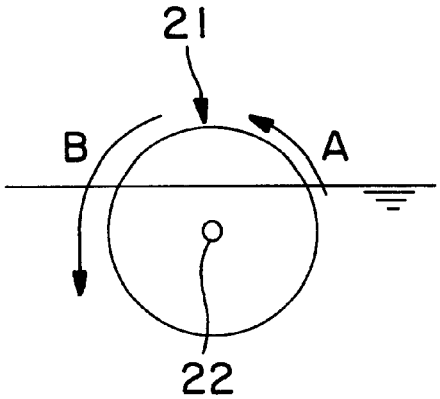
FIG. 3 is a schematic diagram showing the intermittent impact stirring action by the rotor.
Figure 4:
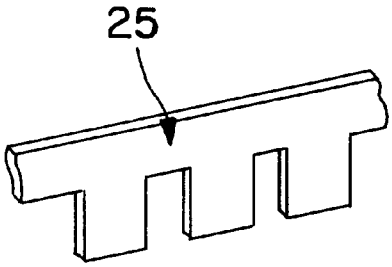
FIG. 4 is a schematic diagram showing a plate.

As rotors 21, as shown in FIG. 2, either of a standard type (FIG. 2A), a helical type (FIG. 2B) or a staggered type (FIG. 2C) can be used. Rotors 21 advance the dissolution of the mixture by the intermittent impact stirring action such as rise (scooping up) A and fall B of the mixture, accompanying the rotation of blades 23 thereof (FIG. 3).

The rotor chamber 13 has a plurality of rotors 21A to 21E arranged in parallel, and the direction to be arranged is designated as a dissolution flow direction of the mixture (24).

The rotor chamber 13 is provided with hampering plates 25 (FIG. 4) having protrusions in the scattering direction of the mixture around rotors 21C to 21E. The hampering plates 25 stop, rest, and then drop the mixture which is scooped up and scattered from rotors 21C to 21E, to advance the dissolution of the mixture.

A partition plate 26 is provided at the outlet of the rotor chamber 13 to set the liquid level of the mixture in the rotor chamber 13 (the medium level of the rotor 21). The partition plate 26 is oscillated by a driving section (not shown) to adjust the liquid level, thereby the degree of the mixture dissolved in the rotor chamber 13 can be adjusted.

A flow rate-adjusting plate 27 is provided in the lower part of the partition plate 26 in the rotor chamber 13 to make it possible to adjust the volume of the mixture fed from the rotor chamber 13 to the screw chamber 14 by adjusting the extent of opening of the flow rate-adjusting plate 27.

Figure 5:
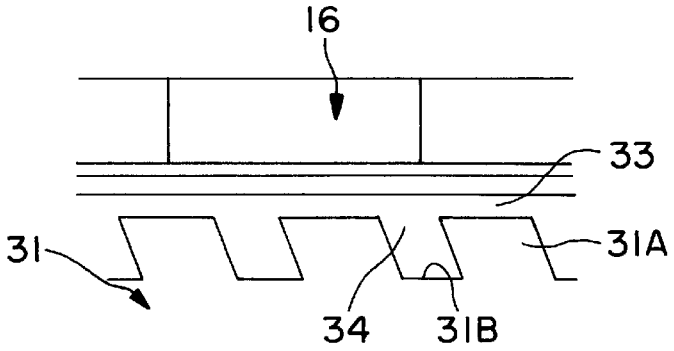
FIG. 5 is a schematic diagram showing passages for pressurization and relaxation around a screw axis.

The screw chamber 14 follows the rotor chamber 13, and has a screw axis 31. The screw axis 31 is driven by a motor 32. The screw chamber 14 includes, as shown in FIG. 5, a narrow pressurization passage 33 which is formed between the outer periphery of helical vane portions 31A of the screw axis 31 and the inner periphery of the screw chamber 14, and a wide relaxation passage 34 which is formed between the non-vane portions 31B of the screw axis 31 and the inner periphery of the screw chamber 14, in the axial direction of the screw axis 31. Thereby, the screw chamber 14 alternately repeats the pressurization in the pressurization passage 33 and the relaxation in the relaxation passage 34 by the rotation of the screw axis 31 with respect to the mixture fed from the rotor chamber 13, to uniformalize the concentration of the mixture (remove the unevenness in the concentration) while advancing the dissolution of the mixture.

Figure 6A:
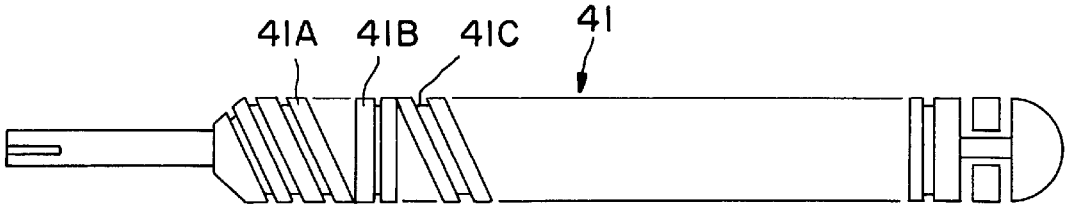
FIGS. 6A and 6B are schematic diagrams showing variations of the screw axis.
Figure 6B:
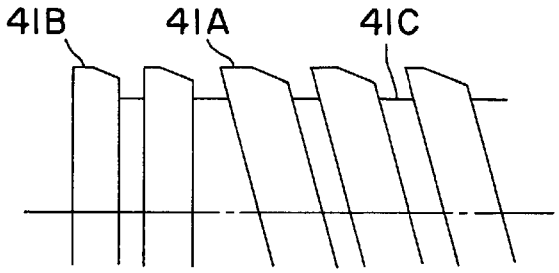
Figure 7:
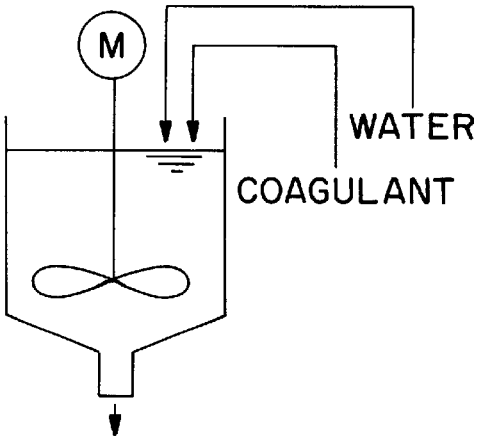
FIG. 7 PRIOR ART
FIG. 7 is a schematic diagram showing a conventional structure.
Figure 8A:
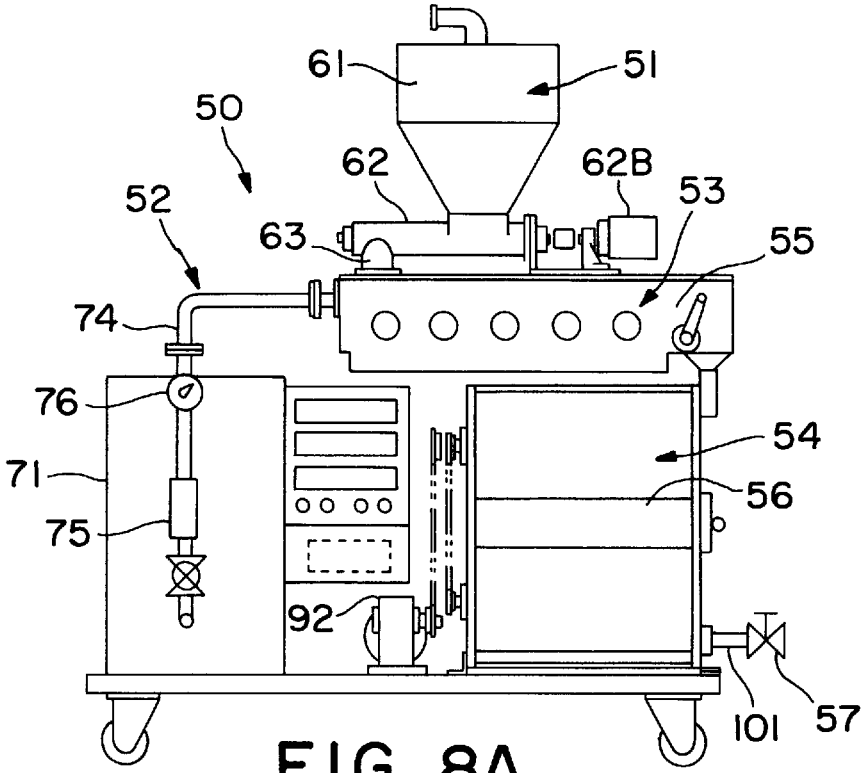
FIGS. 8A and 8B are schematic diagrams showing the second embodiment of the present invention.
Figure 8B:
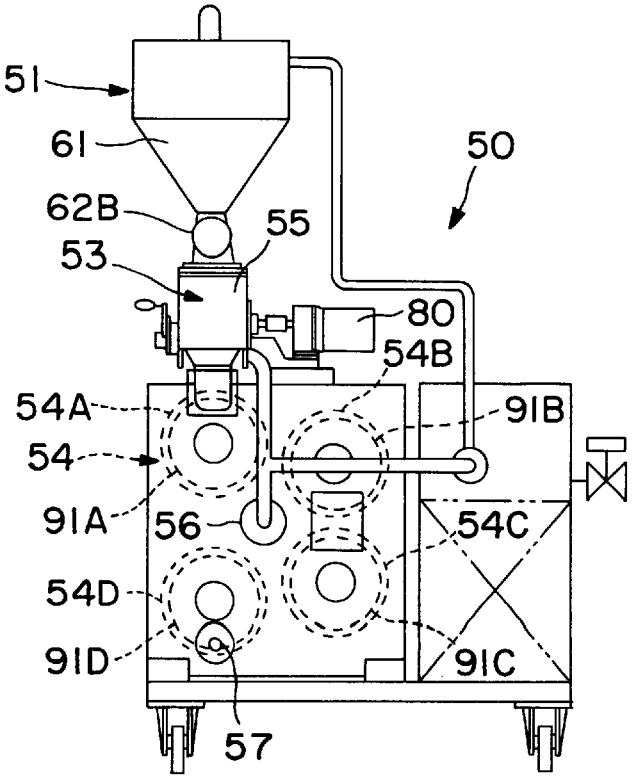

In addition, a screw axis 41 as shown in FIGS. 6A and 6B may be used in the screw chamber 14. The screw axis 41 includes helical vane portions 41A, ring-shaped vane portions 41B and non-vane portions 41C. In the screw chamber 14 using the screw axis 41, helical vane portions 41A dissolve the mixture while feeding the mixture forward in the pressurization passage formed between the helical vane portions 41A and the screw chamber 14. The ring-shaped vane portions 41B feed forward, and restrains and dissolves the mixture in the pressurization passage formed between the ring-shaped vane portions 41B and the screw chamber 14, and as a result, the degree of the dissolution and the viscosity of the mixture is further enhanced.

The first heater 15 is provided on the periphery of the rotor chamber 13 to raise the temperature of the mixture in the rotor chamber 13, for example, by adjusting the temperature of the oil, and the dissolution speed in the rotor chamber 13 can be increased.

The second heater 16 is provided on the periphery of the screw chamber 14 to raise the temperature of the mixture in the screw chamber 14, for example, by an electric heater or the like, and thereby the dissolution speed in the screw chamber 14 can be increased.

The mixture discharge section 17 is formed with a nozzle 35 at the outlet of the screw chamber 14, to discharge the mixture of which gellation is completed in the screw chamber 14 toward the post dilution stage. Incidentally, the mixture discharge section 17 includes a check valve 36 at the final end of the screw chamber 14. The check valve 36 closes when the inner pressure increases in the screw chamber 14 to make uniform the discharge volume of the mixture from the nozzle 35.

The gellation action of the coagulant by means of the dissolving device 10 is as described below.

(1) The coagulant and water are fed from the coagulant feed section 11 and the water feed section 12, respectively, and the mixture thereof is fed to the rotor chamber 13.

(2) The mixture fed to the rotor chamber 13 is stirred vertically by a low-speed rotation of the rotor 21. The mixture is dissolved, kept the viscosity and gelled by the intermittent impact stirring such as rise (scooping up) and fall accompanying the rotation of the rotor 21.

(3) The mixture gelled in the rotor chamber 13 is fed to the screw chamber 14, and the pressurization in the pressurization passage 33 and the relaxation in the relaxation passage 34 are alternately repeated by means of the rotation of the screw axis 31, to uniformalize the concentration of the mixture while enhancing the dissolution and the viscosity.

Therefore, according to the described embodiment, the effect described below can be obtained:

(1) The mixture of the coagulant and water fed to the rotor chamber 13 is stirred vertically by a low-speed rotation of the rotor 21. The mixture gradually dissolves with the intermittent impact stirring action such as rise (scooping up) and fall accompanying the rotation of the rotor 21 and keeps the viscosity. The viscous mixture bearing the viscosity is further subjected to the intermittent impact stirring including rise (scooping up) and fall accompanying the rotation of the rotor 21 due to the viscosity thereof, and dissolves in a few minutes without harming the viscosity (the viscosity is not harmed because the mixture is not subjected to a high-speed stirring), thus the gellation progresses.

(2) The mixture of which gellation progresses in the rotor chamber 13 is fed to the screw chamber 14, and is subjected to the alternately repeated pressurization in the pressurization passage 33 and relaxation in the relaxation passage 34 by the rotation of the screw axis 31 to uniformalize the concentration distribution of the mixture (to remove the unevenness in the concentration) while enhancing the dissolution and the viscosity.

In addition, the degree of gellation of the coagulant affected by the dissolving device 10 can be adjusted by the rotation speed of the rotor 21 in the rotor chamber 13, the liquid level of the mixture in the rotor chamber 13, the flow velocity of the mixture in the rotor chamber 13, the rotation speed of the screw axis 31 in the screw chamber 14, the clearance of the pressurization passage 33 in the screw chamber 14 (the clearance between the vane portions 31A and the inner periphery of the screw chamber 14) and the flow velocity of the mixture in the screw chamber 14.

According to the experimental results obtained by the inventor, it was found that, in the dissolving device 10, when the temperature of the mixture of the coagulant and water was 21° C., the dissolution time was 11 minutes and 30 seconds, and when the temperature of the mixture was 85° C., the dissolution time was shortened to 2 minutes and 40 seconds.

Second Embodiment

FIGS. 8A, 8B to FIGS. 12A, 12B

As in the first embodiment, the dissolving device 50 is composed of a coagulant feed section 51, a water feed section 52, a rotor chamber 53, a screw chamber 54, a first heater 55, a second heater 56, and a mixture discharge section 57.

The coagulant feed section 51 feeds a coagulant (for example, "DIAFLOC" of Diafloc Company Limited) which is a water-soluble polymer having a high molecular weight, and the water feed section 52 feeds water, and the coagulant and water are mixed and fed to the rotor chamber 53.

The rotor chamber 53 supports rotors 81 driven by a motor 80 on a horizontal axis 82, and the liquid level of the mixture is kept at a medium level of the rotors 81, and the mixture is stirred in the vertical direction by a low-speed rotation of the rotors 81.

The rotors 81 advance the dissolution of the mixture, similarly as the rotors 21 of the dissolving device 10, by the intermittent impact stirring action such as rise (scooping up) A and fall B of the mixture, accompanying the rotation of blades thereof.

The rotor chamber 53 has a plurality of rotors 81A to 81E arranged in parallel, and the direction to be arranged is designated as the dissolution flow direction of the mixture.

The rotor chamber 53 is provided with hampering plates having protrusions in the scattering direction of the mixture around rotors 81C to 81E, as in the rotor chamber 13 of the dissolving device 10. The hampering plates stop, rest then drop the mixture which is scooped up and scattered from rotors 81C to 81E, to further advance the dissolution of the mixture.

A partition plate is provided as in the rotor chamber 13 of the dissolving device 10 at the outlet of the rotor chamber 53 to set the liquid level of the mixture in the rotor chamber 53 (the medium level of the rotor 81). The partition plate is oscillated by a driving section to adjust the liquid level, to adjust the degree of the mixture dissolved in the rotor chamber 53.

A flow rate-adjusting plate is provided in the lower part of the partition plate in the rotor chamber 53 to make it possible to adjust the volume of the mixture fed from the rotor chamber 53 to the screw chamber 54 by adjusting the extent of opening of the flow rate-adjusting plate.

The screw chamber 54 (54A to 54D) follows the rotor chamber 53, and has screw axes 91A to 91D. The screw axes 91A to 91D are driven by a motor 92.

A first heater 55 is provided on the periphery of the rotor chamber 53 to raise the temperature of the mixture in the rotor chamber 53, for example, by adjusting the temperature of the oil, to increase the dissolution speed in the rotor chamber 53.

A second heater 56 is provided on the periphery of the screw chamber 54 to raise the temperature of the mixture in the screw chamber 54, for example, with an electric heater or the like, to increase the dissolution speed of the screw chamber 54.

The mixture discharge section 57 is formed with a nozzle 101 at the outlet of the screw chamber 54, and discharges the mixture in which gellation is completed in the screw chamber 54 toward the dilution stage.

Figure 9:
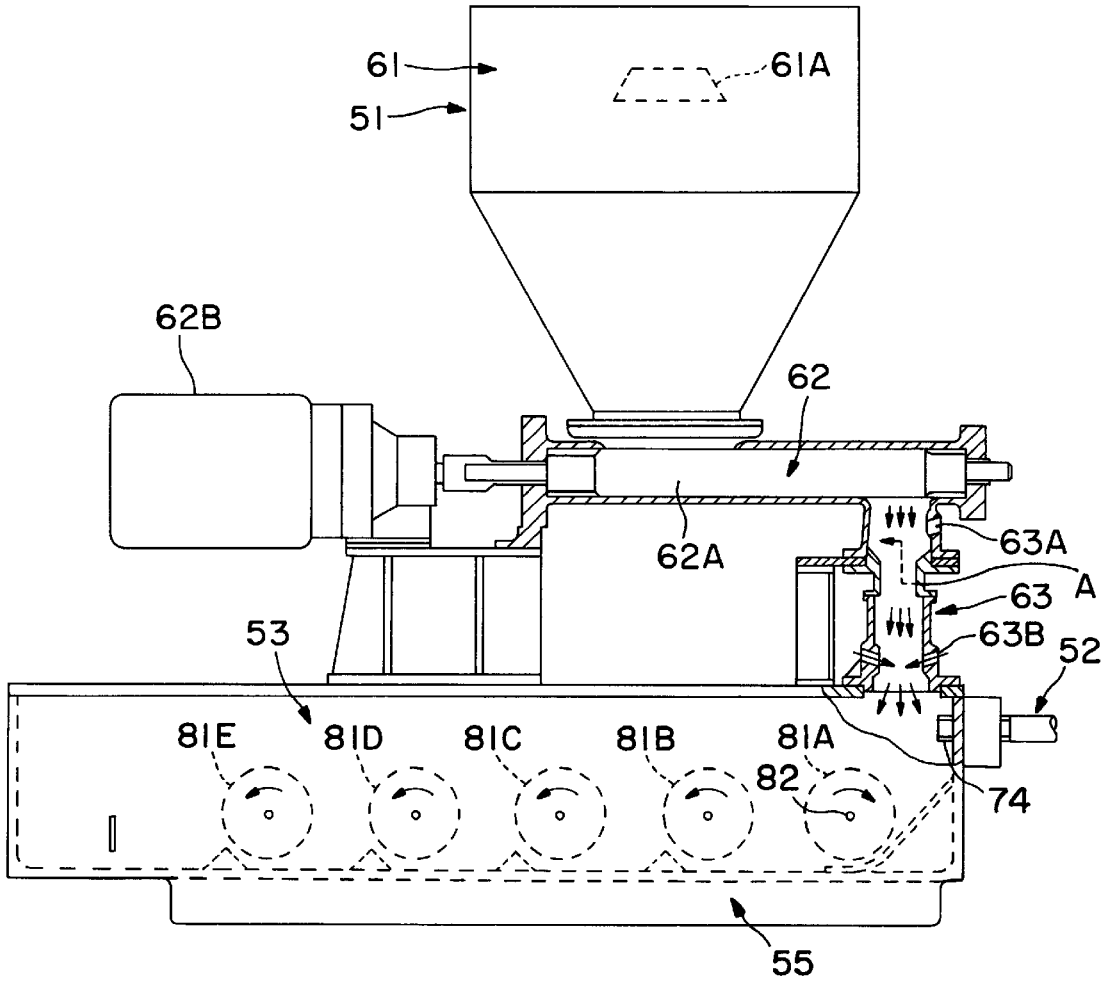
FIG. 9 is a schematic diagram showing a coagulant feed section.

The dissolving device 50 includes the following (A) to (D):

(A) The structure of the coagulant feed section 51 (FIG. 9)

The coagulant feed section 51 has the structure described below in order to correctly weigh the powdery coagulant and feed it smoothly to the rotor chamber 53. Incidentally, in the dissolving device 50, it is required to weigh the feed volume of the coagulant and water with a high accuracy, in order to impart the appropriate and uniform concentration and viscosity to the aqueous solution of the coagulant.

The coagulant feed section 51 has, as shown in FIG. 9, a hopper 61, a screw feeder 62 provided at the outlet of the hopper 61, and a coagulant feed passage 63 which connects the outlet of the screw feeder 62 to the rotor chamber 53. In the screw feeder 62, for example, a feed pitch of 1 g/rotation is provided to a screw vane 62A, and the rotation angle of the screw vane 62A is controlled by an inverter motor 62B to correctly weigh the feed volume (weigh-in).

The hopper 61 is provided with a hot air blowoff section 61A, to make it possible to dry the coagulant in the hopper 61 with this hot air. This hot air utilizes the residual heat of the second heater 56.

An air-blowoff section 63A is provided in the upstream portion of the coagulant feed passage 63, and an air curtain A (FIG. 9) which traverses the coagulant feed passage 63 is formed in the coagulant feed passage 63 to make it possible to prevent water vapor in the rotor chamber 53 from entering into the screw feeder 62.

A hot air blowoff section 63B is provided in the downstream portion of the coagulant feed passage 63, and with this hot air, it becomes possible to widely disperse, that is, to diffuse the coagulant falling in the coagulant feed passage 63 within said feed passage 63. This hot air utilizes the residual heat of the second heater 56.

Figure 10:
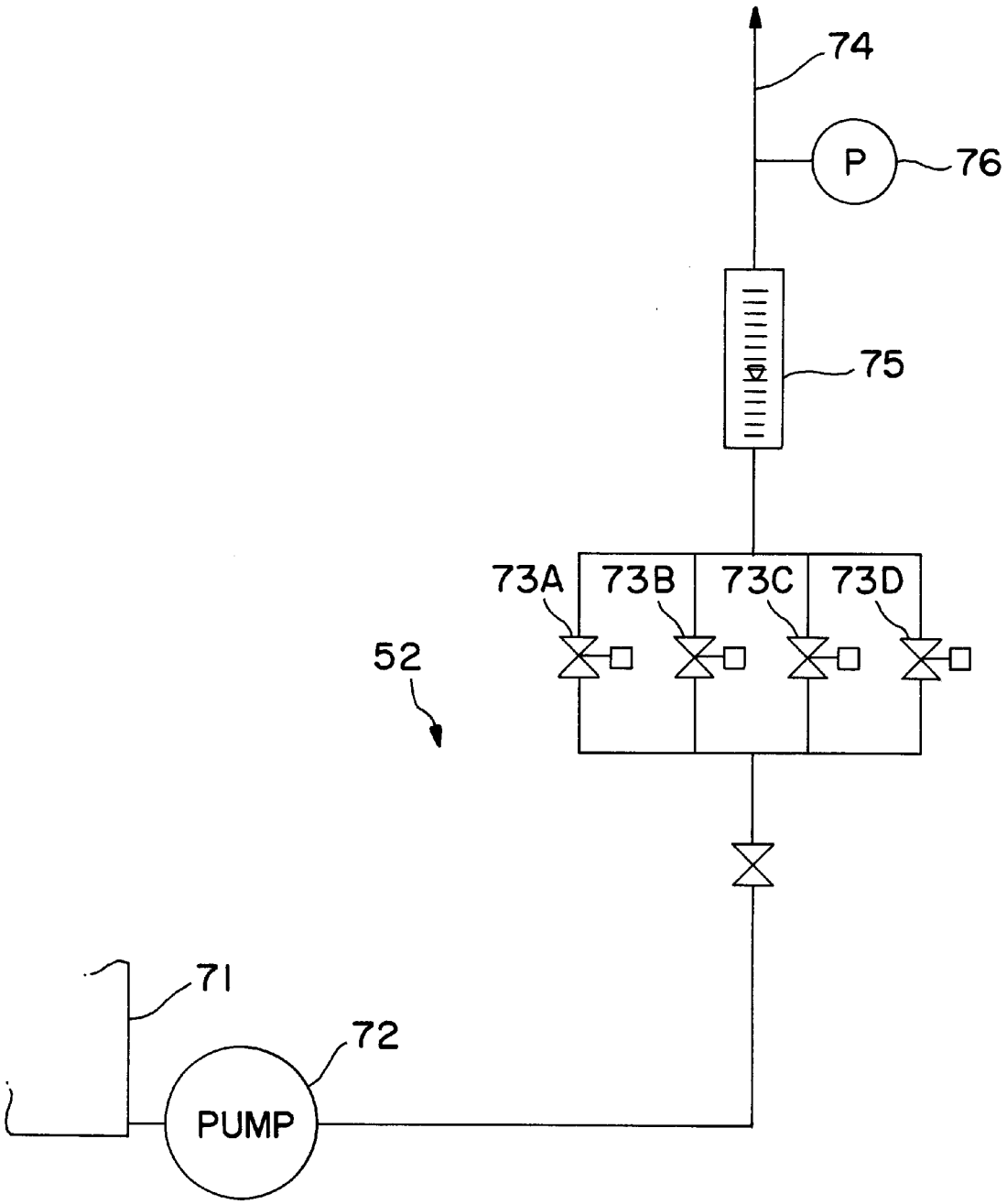
FIG. 10 is a schematic diagram showing a water feed section.

(B) The structure of the water feed section 52 (FIG. 10)

In order to feed water with a high degree of accuracy to the water feed section 52, as shown in FIG. 10, a suction port of a pump 72 is connected to the bottom of the water tank 71, and a plurality of solenoid valves 73 A to 73D are arranged in parallel to each other at the upper position of the discharge port of the pump 72, and a water feed pipe 74 connected to the outlet of the solenoid valves 73A to 73D is so arranged as to face onto the coagulant falling zone of the rotor chamber 53. The water feed section 52 feeds water from the bottom portion in the water tank 71, and air cannot be mixed therein. Furthermore, the water feed section 52 properly selects at least one solenoid valve among solenoid valves 73A to 73D to fully open, and the water feed volume can be set by the sum total of the entire flow rate of respective solenoid valves. For example, when it is assumed that each entire flow rate of respective solenoid valves 73A to 73D is set to 3 L, 8 L, 12 L and 15 L, the water feed volume becomes 11 L if the solenoid valve 73A and the solenoid valve 73B are fully opened, and the solenoid valve 73C and the solenoid valve 73D are fully closed.

In addition, a water feed section 52 is provided with a flow rate-display section 75 and a pressure gauge 76 in the middle of the water feed pipe 74.

Figure 11:
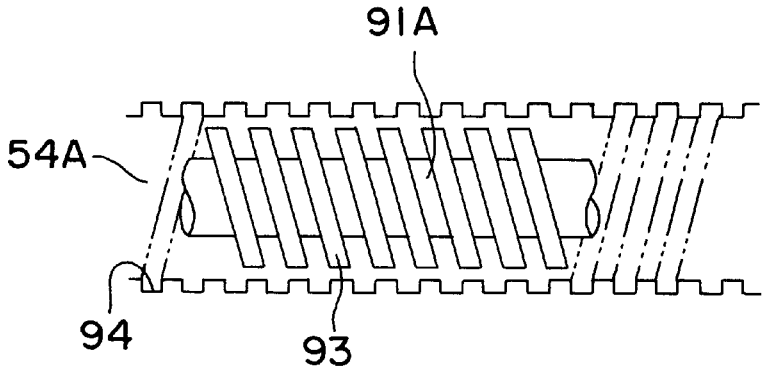
FIG. 11 is a schematic diagram showing the direction of helix of a screw chamber and the screw axis.

(C) The structure of the screw chambers 54A to 54D and the screw axes 91A to 91D (FIG. 11)

Helical grooves 94 are provided in the inner periphery of the screw chamber 54A (or 54B to 54D) surrounding the outer periphery of helical vane portions 93 of the screw axes 91A (or 91B to 91D). The direction of helix of the helical vane portions 93 of the screw axis 91A (for example, right-hand screw) is made opposite to the direction of helix of the helical grooves 94 of the screw chamber 54A (for example, left-hand screw). Thereby, turbulence of the coagulant is caused in the clearance between the screw axis 91A and the screw chamber 54A to avoid the residence of the coagulant around the screw axis 91A, and to uniformalize the concentration distribution of the coagulant without suspending the feed function of the screw axis 91A.

Furthermore, the surfaces of the outer periphery of the screw axis 91A (or 91B to 91D) and the inner periphery of the screw chamber 54A (54B to 54D) are roughed by knurling or sand blasting, or the like. Thereby, the undissolved powdery coagulant in the mixture, which is referred to as "unmixed-in lump of flour", is destroyed by contacting these rough surfaces, and being dissolved in water to uniformalize the dissolution and, as a result, the concentration distribution.

Figure 12A:
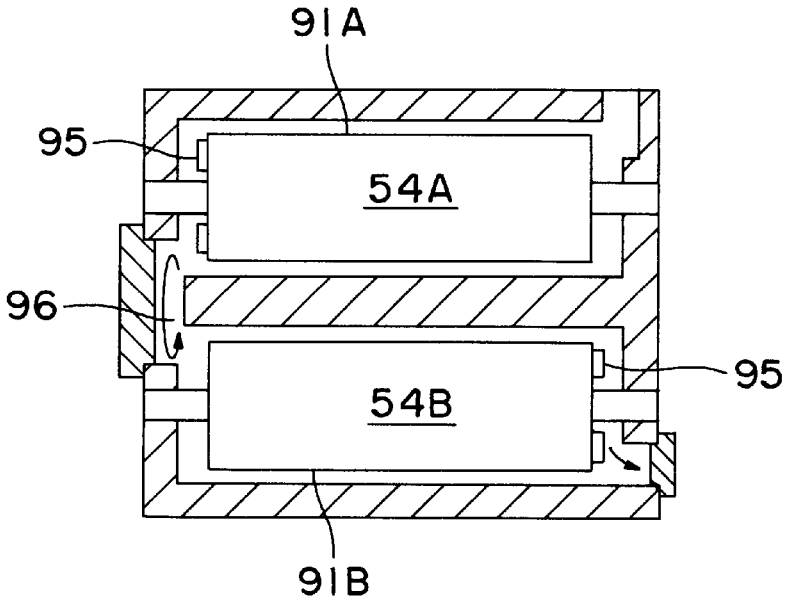
FIGS. 12A and 12B are schematic diagrams showing a circulation structure of the screw chamber.
Figure 12B:
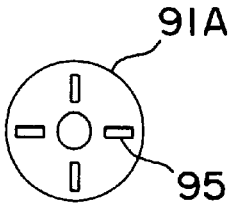

(D) Division of the screw chamber 54 (FIGS. 12A, 12B)

The device is made compact by shortening by not arranging the screw chamber 54 continuously in the single axis direction, but instead dividing the screw chamber 54 into, for example, four, and arranging the divided screw chambers 54A to 54D in parallel. In this case, a solution feed vane 95 is fixed, as shown in FIG. 12, to the end face of the outlet of the screw axis 91A (91B to 91D) arranged in each screw chamber 54A (or 54B to 54D), and by this solution feed vane 95, the mixture solution at the outlet end of the screw chamber 54A is fed to the circulating passage 96 toward the following screw chamber 54B.

In addition, the screw axes 91A to 91D have helical vane portions 93 in different shapes from one another. For example, the screw axis 91A has a large lead angle to increase the feed capability, the screw axes 91B and 91C have a small lead angle, respectively, to increase the capability to accelerate the dissolution of the coagulant and remove the unevenness in the concentration, and the screw axis 91D has a large lead angle to increase the discharge capability.

The gellation action of the coagulant by means of the dissolving device 50 is performed as described below:

(1) The coagulant and water are fed from the coagulant feed section 51 and the water feed section 52, respectively, and the mixture thereof is fed to the rotor chamber 53.

(2) The mixture fed to the rotor chamber 53 is stirred vertically by a low-speed rotation of the rotor 81. The mixture is dissolved to keep the viscosity and gelled by the intermittent impact stirring such as rise (scooping up) and fall accompanying the rotation of the rotor 81.

(3) The mixture gelled in the rotor chamber 53 is fed to the screw chamber 54, and the concentration of the mixture is uniformalized while enhancing the dissolution and the viscosity by the rotation of the screw axes 91A to 91D.

Therefore, according to the present embodiment, the effect described below can be obtained:

(1) The mixture of the coagulant and water fed to the rotor chamber 53 is stirred vertically by a low-speed rotation of the rotor 81. The mixture gradually dissolves with the intermittent impact stirring including rise (scooping up) and fall accompanying the rotation of the rotor 81 and keeps the viscosity. The viscous mixture is further subjected to the intermittent impact stirring including rise and fall accompanying the rotation of the rotor 81 due to the viscosity thereof, and dissolves in a few minutes without harming the viscosity (the viscosity is not harmed because the mixture is not subjected to a high-speed stirring), thus the gellation progresses.

(2) The presence of the hot air blowoff section 61A provided in the hopper 61 makes it possible to dry the coagulant well in the hopper 61, and prevents the coagulant from being set in the hopper 61, thereby the coagulant can be fed from the hopper 61 to the rotor chamber 53 stably.

(3) The presence of the air blowoff section 63A provided in the coagulant feed passage 63 forms the air curtain A in the coagulant feed passage 63 to prevent water vapor in the rotor chamber 53 from entering into the screw feeder 62, thereby preventing setting of the coagulant in the screw feeder 62.

(4) The presence of the hot air blowoff section 63B provided in the coagulant feed passage 63 lets the coagulant fed from the screw feeder 62 disperse widely, that is, diffuse in the coagulant feed passage 63 to prevent poor rotation of the rotor 81 caused by the coagulant adhered to the rotor 81 in a lump.

(5) If the inner periphery of the screw chambers 54A to 54D surrounding the outer periphery of the vane portions 93 of the screw axes 91A to 91D has a smooth surface, and when the viscous coagulant becomes a gel form, the coagulant resides around the screw axes 91A to 91D, and the feed function by the screw is suspended. If the inner periphery of the screw chambers 54A to 54D is provided with helical grooves 94, and the direction of helix of the screw axes 91A to 91D and the direction of the helix of the helical grooves 94 of the screw chambers 54A to 54D are made opposite to each other, turbulence of the coagulant is caused in the clearance between the screw axes 91A to 91D and the screw chambers 54A to 54D to avoid the residence of the coagulant around the screw axes 91A to 91D, and to uniformalize the concentration distribution of the coagulant without suspending the feed function of the screw.

As described above, according to the present invention, the mixture of the coagulant and water can be gelled within a short period of time without harming the viscosity.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

What is claimed is:

1. A device for dissolving a coagulant in which the coagulant is gelled by adding water comprising:

a rotor chamber;

a coagulant feed section for feeding powdery coagulant to the rotor chamber, the coagulant feed section comprising a hopper having an inlet and outlet and an axis therebetween, a screw feeder provided at the outlet of the hopper, and a coagulant feed passage for connecting the screw extrusion to the rotor chamber;

a hot air blowoff section provided in the hopper for driving the coagulant in the hopper;

an air blowoff section provided in the coagulant feed passage for forming an air curtain in the coagulant feed passage, said air curtain formed in a direction traversing the axis of the coagulant feed passage, said air curtain formed to prevent water vapor in the rotor chamber from entering into the screw feeder; and a hot air blowoff section provided in the coagulant feed passage for diffusing coagulant moving in the coagulant feed passage within the coagulant feed passage;

a plurality of rotors supported within the rotor chamber along a horizontal plane, each of said rotors rotatable about a respective axis such that a mixture of coagulant and water are directed by said rotors along a dissolving flow direction within said rotor chamber, at least one of said rotors having a hampering plate associated therewith, said hampering plate having protrusions projecting in the flow direction of the mixture;

means for feeding a mixture of the coagulant and water to the rotor chamber;

means for keeping a level of the mixture at a midpoint of the rotors, the rotors being adapted to stir the mixture in the vertical direction by the rotation of the rotors; and a heater around said rotor chamber.

2. The device according to claim 1 further including a screw chamber in communication with said rotor chamber, said screw chamber defined by an inner periphery and including a screw extrusion therein, said screw extrusion having an axis and a plurality of vane portions spaced along said axis, said vanes each having an outer periphery wherein a narrow pressurization passage is formed between the outer periphery of the vane portions of the screw extrusion and the inner periphery of the screw chamber, and wherein a wide relaxation passage is formed between the screw extrusion and the inner periphery of the screw chamber in-between said vane portions, the pressurization passage and the relaxation passage alternately repeated along said axis, whereby rotation of the screw extrusion causes a repeating pattern of pressurization and relaxation with respect to the mixture fed from the rotor chamber.

3. The device according to claim 2, further including helical grooves provided on the inner periphery of the screw chamber, wherein said vane portions of said screw extrusion are comprised of a combination of vane portions having a helical shape and a ring shape, said helical grooves of said screw chamber surrounding the outer periphery of each of said vane portions on said screw extrusion, all of said helical-shaped vane portions facing a same direction and all of the helical grooves of said screw chamber facing a same direction, opposite to said direction of said helical-shaped vane portions.

* * * * *